US011229297B2

(12) United States Patent
Gaunt

(10) Patent No.: US 11,229,297 B2
(45) **Date of Patent: *Jan. 25, 2022**

(54) ADJUSTABLE FOUNDATION WITH SERVICE POSITION

(71) Applicant: Sleep Number Corporation, Minneapolis, MN (US)

(72) Inventor: Bruce William Gaunt, Albertville, MN (US)

(73) Assignee: Sleep Number Corporation, Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/930,680

(22) Filed: Jul. 16, 2020

(65) Prior Publication Data

US 2021/0037986 A1 Feb. 11, 2021

Related U.S. Application Data

(63) Continuation of application No. 15/806,810, filed on Nov. 8, 2017, now Pat. No. 10,729,253.

(60) Provisional application No. 62/419,710, filed on Nov. 9, 2016.

(51) Int. Cl.

| | |
|---|---|
| ***A47C 20/04*** | (2006.01) |
| ***A47C 19/02*** | (2006.01) |
| ***A47C 31/00*** | (2006.01) |
| ***A47C 27/08*** | (2006.01) |
| ***A47C 27/10*** | (2006.01) |

(52) U.S. Cl.

CPC ..... *A47C 20/041* (2013.01); *A47C 19/025* (2013.01); *A47C 27/082* (2013.01); *A47C 27/083* (2013.01); *A47C 27/10* (2013.01); *A47C 31/008* (2013.01)

(58) Field of Classification Search

CPC ... A47C 20/041; A47C 19/025; A47C 27/082; A47C 27/083; A47C 27/10; A47C 31/008

See application file for complete search history.

(56) References Cited

U.S. PATENT DOCUMENTS

| | | | |
|---|---|---|---|
| 3,465,373 | A | 9/1969 | Wilson |
| 4,766,628 | A | 8/1988 | Greer et al. |
| 4,788,729 | A | 12/1988 | Greer et al. |
| D300,194 | S | 3/1989 | Walker |
| 4,829,616 | A | 5/1989 | Walker |
| 4,890,344 | A | 1/1990 | Walker |

(Continued)

OTHER PUBLICATIONS

U.S. Appl. No. 29/583,852, filed Nov. 9, 2016, Keeley.

*Primary Examiner* — David R Hare
*Assistant Examiner* — Adam C Ortiz
(74) *Attorney, Agent, or Firm* — Fish & Richardson P.C.

(57) ABSTRACT

A foundation for a bed system can include an actuator, a deck mechanism operably related to the actuator so as to be actuated between raised and lowered positions in response to actuation by the actuator, and a controller operably connected to the actuator and configured to drive the actuator to actuate the deck mechanism between a lower position and an upper position. The deck mechanism can be configured to move to a service position that is further than the upper position. The deck mechanism can expose and permit access to a serviceable component when the deck mechanism is in the service position. A method of using a foundation having a service position is also described.

19 Claims, 16 Drawing Sheets

(56) References Cited

U.S. PATENT DOCUMENTS

| | | | |
|---|---|---|---|
| 4,897,890 | A | 2/1990 | Walker |
| 4,908,895 | A | 3/1990 | Walker |
| D313,973 | S | 1/1991 | Walker |
| 4,991,244 | A | 2/1991 | Walker |
| 5,020,173 | A | 6/1991 | Dreyer, Jr. |
| 5,072,463 | A | 12/1991 | Willis |
| 5,095,561 | A | 3/1992 | Green et al. |
| 5,144,706 | A | 9/1992 | Walker et al. |
| 5,170,522 | A | 12/1992 | Walker |
| D368,475 | S | 4/1996 | Scott |
| 5,509,154 | A | 4/1996 | Shafer et al. |
| 5,564,140 | A | 10/1996 | Shoenhair et al. |
| 5,642,546 | A | 6/1997 | Shoenhair |
| 5,652,484 | A | 7/1997 | Shafer et al. |
| 5,715,548 | A | 2/1998 | Weismiller et al. |
| 5,765,246 | A | 6/1998 | Shoenhair |
| 5,903,941 | A | 5/1999 | Shafer et al. |
| 5,904,172 | A | 5/1999 | Gifft et al. |
| 6,012,186 | A | 1/2000 | Soltani et al. |
| 6,037,723 | A | 3/2000 | Shafer et al. |
| 6,079,065 | A | 6/2000 | Luff |
| 6,108,844 | A | 8/2000 | Kraft et al. |
| 6,161,231 | A | 12/2000 | Kraft et al. |
| 6,163,904 | A | 12/2000 | Royston |
| 6,202,239 | B1 | 3/2001 | Ward et al. |
| 6,209,157 | B1 | 4/2001 | Hensley |
| 6,397,419 | B1 | 6/2002 | Mechache |
| 6,483,264 | B1 | 11/2002 | Shafer et al. |
| 6,686,711 | B2 | 2/2004 | Rose et al. |
| 6,708,357 | B2 | 3/2004 | Gaboury et al. |
| 6,708,358 | B2 | 3/2004 | Hensley |
| 6,763,541 | B2 | 7/2004 | Mahoney et al. |
| 6,804,848 | B1 | 10/2004 | Rose |
| 6,832,397 | B2 | 12/2004 | Gaboury |
| D502,929 | S | 3/2005 | Copeland et al. |
| 6,883,191 | B2 | 5/2005 | Gaboury et al. |
| 7,389,554 | B1 | 6/2008 | Rose |
| 7,865,988 | B2 | 1/2011 | Koughan et al. |
| 8,099,807 | B2 | 1/2012 | Heimbrock et al. |
| 8,209,800 | B2 | 6/2012 | Shih |
| 8,209,801 | B2 | 7/2012 | Shih |
| 8,336,369 | B2 | 12/2012 | Mahoney |
| 8,444,558 | B2 | 5/2013 | Young et al. |
| 8,484,773 | B2 | 7/2013 | Blevins |
| D691,118 | S | 10/2013 | Ingham et al. |
| D697,874 | S | 1/2014 | Stusynski et al. |
| D698,338 | S | 1/2014 | Ingham |
| D701,536 | S | 3/2014 | Sakal |
| 8,672,853 | B2 | 3/2014 | Young |
| 8,769,747 | B2 | 7/2014 | Mahoney et al. |
| 8,806,682 | B2 | 8/2014 | Hornbach et al. |
| 8,893,339 | B2 | 11/2014 | Fleury |
| 8,909,378 | B2 | 12/2014 | Rawls-Meehan |
| 8,910,328 | B2 | 12/2014 | Clenet |
| 8,931,329 | B2 | 1/2015 | Mahoney et al. |
| 8,966,689 | B2 | 3/2015 | McGuire et al. |
| 8,973,183 | B1 | 3/2015 | Palashewski et al. |
| 8,984,687 | B2 | 3/2015 | Stusynski et al. |
| D737,250 | S | 8/2015 | Ingham et al. |
| 9,119,753 | B2 | 9/2015 | Poulos et al. |
| 9,131,781 | B2 | 9/2015 | Zaiss et al. |
| 9,370,457 | B2 | 6/2016 | Nunn et al. |
| 9,392,879 | B2 | 7/2016 | Nunn et al. |
| 9,510,688 | B2 | 12/2016 | Nunn et al. |
| 9,730,524 | B2 | 8/2017 | Chen et al. |
| 9,737,154 | B2 | 8/2017 | Mahoney et al. |
| 9,770,114 | B2 | 9/2017 | Brosnan et al. |
| D809,843 | S | 2/2018 | Keeley et al. |
| D812,393 | S | 3/2018 | Karschnik et al. |
| 9,918,555 | B2 | 3/2018 | Gopalakrishnan et al. |
| 10,342,358 | B1 | 7/2019 | Palashewski et al. |
| 10,729,253 | B1 | 8/2020 | Gaunt |
| 2007/0245489 | A1 | 10/2007 | Boudreau |
| 2008/0077020 | A1 | 3/2008 | Young et al. |
| 2008/0262657 | A1 | 10/2008 | Howell et al. |
| 2008/0276373 | A1 | 11/2008 | Clenet |
| 2011/0144455 | A1 | 6/2011 | Young et al. |
| 2011/0247138 | A1 | 10/2011 | Clenet et al. |
| 2012/0124752 | A1 | 5/2012 | Patrick |
| 2014/0250597 | A1 | 9/2014 | Chen et al. |
| 2014/0259418 | A1 | 9/2014 | Nunn et al. |
| 2014/0259433 | A1 | 9/2014 | Nunn et al. |
| 2014/0277611 | A1 | 9/2014 | Nunn et al. |
| 2014/0277778 | A1 | 9/2014 | Nunn et al. |
| 2014/0277822 | A1 | 9/2014 | Nunn et al. |
| 2015/0007393 | A1 | 1/2015 | Palashewski |
| 2015/0025327 | A1 | 1/2015 | Young et al. |
| 2015/0026896 | A1 | 1/2015 | Fleury et al. |
| 2015/0157519 | A1 | 6/2015 | Stusynski et al. |
| 2015/0182397 | A1 | 7/2015 | Palashewski et al. |
| 2015/0182399 | A1 | 7/2015 | Palashewski et al. |
| 2015/0182418 | A1 | 7/2015 | Zaiss |
| 2015/0290059 | A1 | 10/2015 | Brosnan et al. |
| 2015/0366366 | A1 | 12/2015 | Zaiss et al. |
| 2016/0100696 | A1 | 4/2016 | Palashewski et al. |
| 2016/0120327 | A1* | 5/2016 | Shimada ..... A47C 19/12 5/11 |
| 2016/0192886 | A1 | 7/2016 | Nunn et al. |
| 2016/0193095 | A1 | 7/2016 | Roussy et al. |
| 2016/0206488 | A1 | 7/2016 | Bellingroth |
| 2016/0242562 | A1 | 8/2016 | Karschnik et al. |
| 2016/0338871 | A1 | 11/2016 | Nunn et al. |
| 2016/0367039 | A1 | 12/2016 | Young et al. |
| 2017/0003666 | A1 | 1/2017 | Nunn et al. |
| 2017/0035212 | A1 | 2/2017 | Nunn et al. |
| 2017/0049243 | A1 | 2/2017 | Nunn et al. |
| 2017/0196369 | A1 | 7/2017 | Nunn et al. |
| 2017/0303697 | A1 | 10/2017 | Chen et al. |
| 2017/0318980 | A1 | 11/2017 | Mahoney et al. |
| 2017/0354268 | A1 | 12/2017 | Brosnan et al. |
| 2018/0116415 | A1 | 5/2018 | Karschnik et al. |
| 2018/0116418 | A1 | 5/2018 | Shakal et al. |
| 2018/0116419 | A1 | 5/2018 | Shakal |
| 2018/0119686 | A1 | 5/2018 | Shakal et al. |
| 2018/0125259 | A1 | 5/2018 | Peterson et al. |
| 2018/0125260 | A1 | 5/2018 | Peterson et al. |
| 2019/0059603 | A1 | 2/2019 | Griffith et al. |

* cited by examiner

ADJUSTABLE FOUNDATION WITH SERVICE POSITION

CROSS-REFERENCE TO RELATED APPLICATIONS

This application is a continuation of U.S. application Ser. No. 15/806,810, filed Nov. 8, 2017, which claims priority to U.S. Application Ser. No. 62/419,710, filed on Nov. 9, 2016.

TECHNICAL FIELD

This invention relates to beds, and more particularly to adjustable foundations for beds.

BACKGROUND

People have traditionally used beds that come in many shapes, sizes, and styles. Such beds can range from extremely simple designs to rather complex designs that include a variety of features. For example, some beds include mattresses that include foam, inner-springs, fluid-inflatable bladders, other materials, or combinations thereof. Such mattresses may or may not be supported by a frame, box spring, adjustable foundation, non-adjustable foundation, or other support structure.

In some cases, an adjustable foundation for a bed can raise and lower portions of the bed, such as the head and/or the foot. Such adjustable foundations can allow the bed to be flat for use in some situations (e.g. when a user wants to sleep flat) and at least partially raised for other situations (e.g. when reading, watching television, and preferring to sleep with a portion of the body raised).

SUMMARY

In general, one innovative aspect of the subject matter described in this specification can be embodied in an adjustable foundation that can be raised to a service position that is high enough to allow for servicing of components in the adjustable foundation. An electric actuator can raise a deck panel of the adjustable foundation between lower and raised positions. A user can select actuation positions between the lower and raised position for user during normal operation and can also manually push the deck panel to a service position that is further than the upper position in order to move the deck panel out of the way and allow access for servicing components, such as electrical components. In some cases, the service position may be further than the actuator can possibly move the deck panel on its own (e.g. without someone pushing the deck panel to the service position.

In one embodiment, a foundation for a bed system can include an actuator, a deck mechanism operably related to the actuator so as to be actuated between raised and lowered positions in response to actuation by the actuator, and a controller operably connected to the actuator and configured to drive the actuator to actuate the deck mechanism between a lower position and an upper position. The deck mechanism is configured to move to a service position that is further than the upper position in response to a user manually moving the deck mechanism to the service position.

Implementations can include any, all, or none of the following features. The deck mechanism includes a first deck panel hingedly connected to at least a second deck panel. The deck mechanism includes a lever arm operably connected to the actuator, a roller attached to the lever arm, and a deck panel. The roller abuts a bottom surface of the deck panel such that actuation of the lever arm to raise the roller causes the roller to press against and lift the deck panel to the upper position. The deck panel is in contact with the roller when in the lower and upper positions and the deck panel is spaced from the roller when the deck panel is in the service position. The deck mechanism includes a foot panel, a second panel hingedly connected to the foot panel, and a third panel hingedly connected to the second panel. The foot panel is positioned at a foot of the foundation. The deck mechanism further includes a frame and a linkage arm connecting the foot panel to the frame. The second panel is hingedly connected to both the foot panel and the frame such that the foot panel functions substantially as a coupler in a four-bar-linkage system that includes the linkage arm, the frame, the second panel, and the foot panel. The linkage arm rotates to a position that is less than vertical when rotating from the lower position to the upper position and the linkage arm rotates to a position that is past vertical when rotated from the upper position to the service position. A compartment is positioned proximate a foot of the foundation and has an openable cover that at least partially conceals components contained therein. The foot panel at least partially conceals the compartment in the lower position and upper positions. An inflatable air mattress is positioned on the foundation and supportable by the foundation. An air controller has a pump positioned in the compartment and fluidly connected to the inflatable air mattress. The air controller can be accessed and serviced when the deck mechanism is in the service position and the air controller is difficult or impossible to access when the deck mechanism is in the lower and upper positions. The controller is configured to drive the actuator to actuate the deck mechanism between the lower position and the upper position and is configured to drive the actuator to actuate the deck mechanism no higher than the upper position. The upper position is the highest position to which the actuator can raise the deck mechanism. The deck mechanism is configured to stay in the service position without assistance of the actuator once the deck mechanism is moved to the service position. The deck mechanism comprises a head panel hingedly connected to a second panel, wherein the head panel is positioned at a head of the foundation. The second panel is rigidly connected to a frame of the foundation. The lower position includes the head panel being substantially flat so as to form an angle with the second panel of about 180 degrees, the upper position includes the head panel forming an angle with the second panel of between 180 and 90 degrees, and the service position includes the head panel forming an angle with the second panel of less than 90 degrees. The head panel can be rotated so far as to lay substantially flat against the second panel. A surround extends around the foundation and has no service openings.

In another embodiment, a foundation for a bed system includes a means for supporting a mattress, a means for actuating at least a portion of the means for supporting the mattress between a lower position and an upper position, and a controller operably connected to the means for actuating. The controller is configured to drive the means for actuating to actuate the means for supporting between the lower position and the upper position. The means for supporting is configured to be manually moved to a service position that is further than the upper position.

Another embodiment is a method for operating a foundation of a bed system. The method includes activating an electrically-powered actuator to raise a portion of the foundation of a bed system from a lower position to an upper position. The upper position is configured for supporting a user resting on a mattress that is supported by the foundation. The method also includes manually pushing the portion of the foundation to a service position that is further than the upper position. The service position is configured to allow access to one or more serviceable components in the foundation.

Implementations can include any, all, or none of the following features. A mattress positioned on the foundation when the foundation is in the upper position can be rested on. The mattress can be removed from the foundation after resting on the mattress and before manually pushing the portion of the foundation to the service position. The one or more serviceable components can be serviced after manually pushing the portion of the foundation to the service position.

These and other embodiments can each optionally include one or more of the features described below. Particular embodiments of the subject matter described in this specification can be implemented so as to realize none, one or more of the advantages described below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
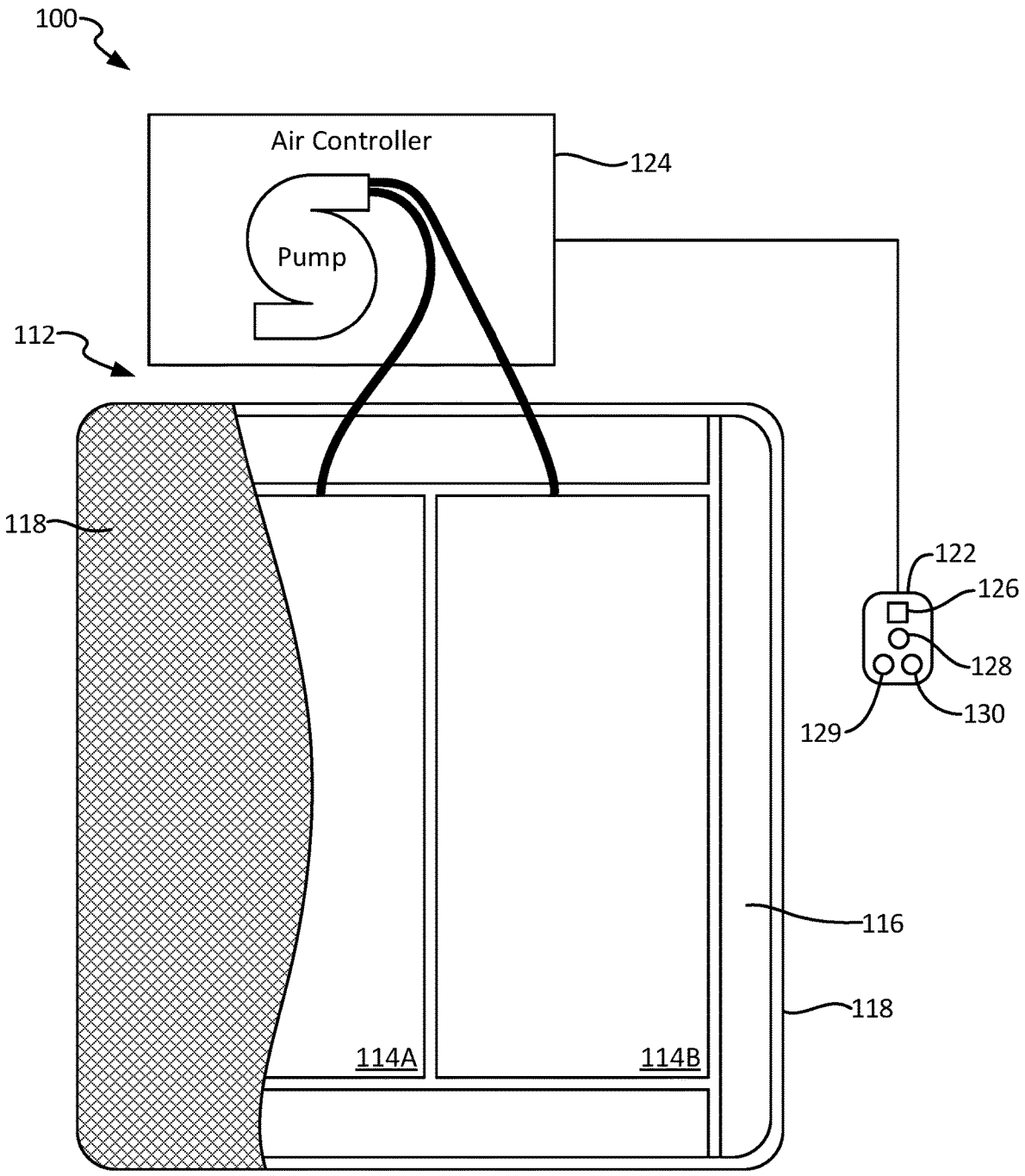
FIG. 1 shows an example air bed system.

FIG. 1 shows an example air bed system 100 that includes a mattress 112. The mattress 112 includes at least one air chamber 114 surrounded by a resilient border 116 and encapsulated by bed ticking 118. The resilient border 116 can comprise any suitable material, such as foam.

As illustrated in FIG. 1, the mattress 112 can be a two chamber design having first and second fluid chambers, such as a first air chamber 114A and a second air chamber 114B. In alternative embodiments, the mattress 112 can include chambers for use with fluids other than air that are suitable for the application. In some embodiments, such as single beds or kids' beds, the mattress 112 can include a single air chamber 114A or 114B or multiple air chambers 114A and 114B. The first and second air chambers 114A and 114B can be in fluid communication with a pump 120. The pump 120 can be part of an air controller 124, which can be in electrical communication with a remote control 122. The air controller 124 can include a wired or wireless communications interface for communicating with one or more devices, including the remote control 122. The air controller 124 can be configured to operate the pump 120 to cause increases and decreases in the fluid pressure of the first and second air chambers 114A and 114B based upon commands input by a user using the remote control 122. In some implementations, the pump 120 and the air controller 124 can be integrated into a common housing. In other embodiments, the air controller 124 and the pump 120 can be in separate housings.

The remote control 122 can include a display 126, an output selecting mechanism 128, a pressure increase button 129, and a pressure decrease button 130. The output selecting mechanism 128 can allow the user to switch air flow generated by the pump 120 between the first and second air chambers 114A and 114B, thus enabling control of multiple air chambers with a single remote control 122 and a single pump 120. For example, the output selecting mechanism 128 can by a physical control (e.g., switch or button) or an input control displayed on display 126. Alternatively, separate remote control units can be provided for each air chamber and can each include the ability to control multiple air chambers. Pressure increase and decrease buttons 129 and 130 can allow a user to increase or decrease the pressure, respectively, in the air chamber selected with the output selecting mechanism 128. Adjusting the pressure within the selected air chamber can cause a corresponding adjustment to the firmness of the respective air chamber. In some embodiments, the remote control 122 can be omitted or modified as appropriate for an application. For example, in some embodiments the air bed system 100 can be controlled by a computer, tablet, smart phone, or other device in wired or wireless communication with the air bed system 100.

Figure 2:
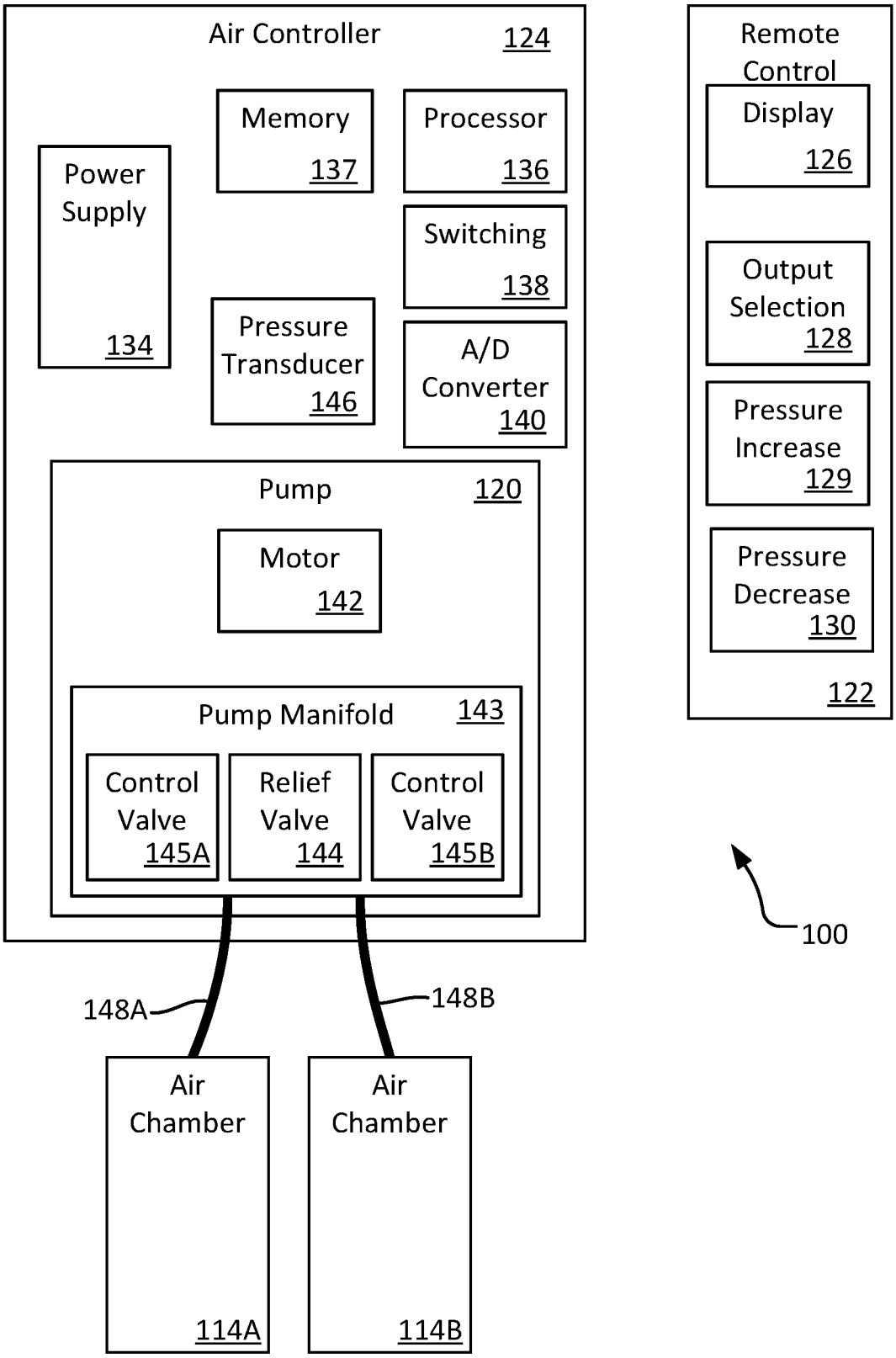
FIG. 2 is a block diagram of various components of the air bed system of FIG. 1, according to an example.

FIG. 2 is a block diagram of an example of various components of an air bed system. For example, these components can be used in the example air bed system 100. As shown in FIG. 2, the air controller 124 can include the pump 120, a power supply 134, a processor 136, a memory 137, a switching mechanism 138, and an analog to digital (A/D) converter 140, an air manifold 143 (having valves 144, 145A, and 145B), and one or more pressure transducers 146. The switching mechanism 138 can be, for example, a relay or a solid state switch.

The pump 120 can include a motor 142. The pump 120 can be fluidly connected to the pump manifold, which is fluidically connected with the first air chamber 114A and the second air chamber 114B via a first tube 148A and a second tube 148B, respectively. The first and second control valves 145A and 145B can be controlled by switching mechanism 138, and are operable to regulate the flow of fluid between the pump 120 and first and second air chambers 114A and 114B, respectively.

In some implementations, the pump 120 and the air controller 124 can be provided and packaged as a single unit. In some alternative implementations, the pump 120 and the air controller 124 can be provided as physically separate units. In some implementations, the air controller 124, the pump 120, or both are integrated within or otherwise contained within a bed frame or bed support structure that supports the mattress 112. In some implementations, the air controller 124, the pump 120, or both are located outside of a bed frame or bed support structure (as shown in the example in FIG. 1).

The example air bed system 100 depicted in FIG. 2 includes the two air chambers 114A and 114B and the single pump 120. However, other implementations can include an air bed system having two or more air chambers and one or more pumps incorporated into the air bed system to control the air chambers. For example, a separate pump can be associated with each air chamber of the air bed system or a pump can be associated with multiple chambers of the air bed system. Separate pumps can allow each air chamber to be inflated or deflated independently and simultaneously. Furthermore, additional pressure transducers can also be incorporated into the air bed system such that, for example, a separate pressure transducer can be associated with each air chamber.

In use, the processor 136 can, for example, send a decrease pressure command for one of the air chambers 114A or 114B, and the switching mechanism 138 can be used to convert the low voltage command signals sent by the processor 136 to higher operating voltages sufficient to operate the relief valve 144 of the pump 120 and open the control valve 145A or 145B. Opening the relief valve 144 can allow air to escape from the air chamber 114A or 114B through the respective air tube 148A or 148B. During deflation, the pressure transducer 146 can send pressure readings to the processor 136 via the A/D converter 140. The A/D converter 140 can receive analog information from pressure transducer 146 and can convert the analog information to digital information useable by the processor 136. The processor 136 can send the digital signal to the remote control 122 to update the display 126 in order to convey the pressure information to the user. Alternatively, one or more of the air chambers 114A and 114B can be deflated without opening the relief valve 144 as further described below.

As another example, the processor 136 can send an increase pressure command. The pump motor 142 can be energized in response to the increase pressure command and send air to the designated one of the air chambers 114A or 114B through the air tube 148A or 148B via electronically operating the corresponding valve 145A or 145B. While air is being delivered to the designated air chamber 114A or 114B in order to increase the firmness of the chamber, the pressure transducer 146 can sense pressure within the air manifold 143. Again, the pressure transducer 146 can send pressure readings to the processor 136 via the A/D converter 140. The processor 136 can use the information received from the A/D converter 140 to determine the difference between the actual pressure in air chamber 114A or 114B and the desired pressure. The processor 136 can send the digital signal to the remote control 122 to update display 126 in order to convey the pressure information to the user.

In some embodiments, the mattress 112 can be used with foundation, such as an adjustable foundation (not shown in FIG. 2). For example, the mattress 112 can be positioned on and supported by an adjustable foundation that is configured to raise and lower portions of the mattress 112, such as the head and foot of the mattress 112. In some of such embodiments, the remote control 122 can one or more selections for actuating the adjustable foundation. Examples of such adjustable foundations are further described below.

Figure 3:
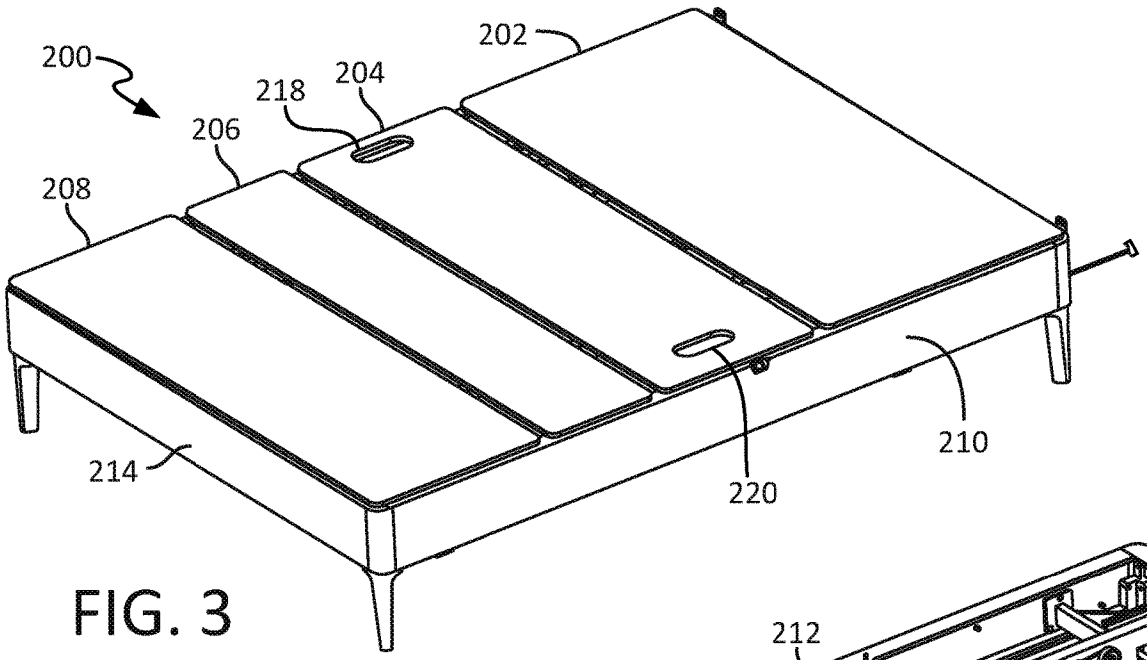
FIG. 3 is a perspective view of an embodiment of a foundation.

FIG. 3 is a perspective view of a foundation 200. As illustrated in FIG. 3, the foundation 200 can include one or more deck panels 202, 204, 206, 208, side rails 210 and 212 (the side rail 212 is not shown in FIG. 3), a foot rail 214, and a head rail 216 (not shown in FIG. 3). In some embodiments the foundation 200 can be an articulating foundation, such that one or more of the deck panels 202, 204, 206, 208 are raised and lowered in response to actuating motors. For example the deck panel 202 can be a head deck panel for raising and lowering a head of a mattress. The deck panel 204 can be a back or hip deck panel that remains substantially stationary during actuation. The deck panel 206 can be a thigh deck panel for raising a thigh section of the mattress at an angle. The deck panel 208 can be a foot deck panel for raising and lowering a foot portion of the mattress. The deck panels 202, 204, 206, 208 can be connected to an articulation mechanism (not shown in FIG. 3) for articulating one or more of the deck panels 202, 204, 206, 208.

In the illustrated embodiment, the deck panel 204 defines a pair of passages 218 and 220 which can accommodate connections between components below and above the deck panels 202, 204, 206, 208. For example, one or more hoses (not shown in FIG. 3) can extend from a component, such as the air controller 124, positioned below the deck panels 202, 204, 206, 208 to a portion of a mattress positioned above the deck panels 202, 204, 206, 208, such as one or more inflatable mattress air chambers as described above. The passages 218 and 220 can extend through the a non-articulating deck panel 204 so as to help conceal hoses extending therethrough, even when one or more of the deck panels 202, 206, 208 are articulated up.

Figure 4:
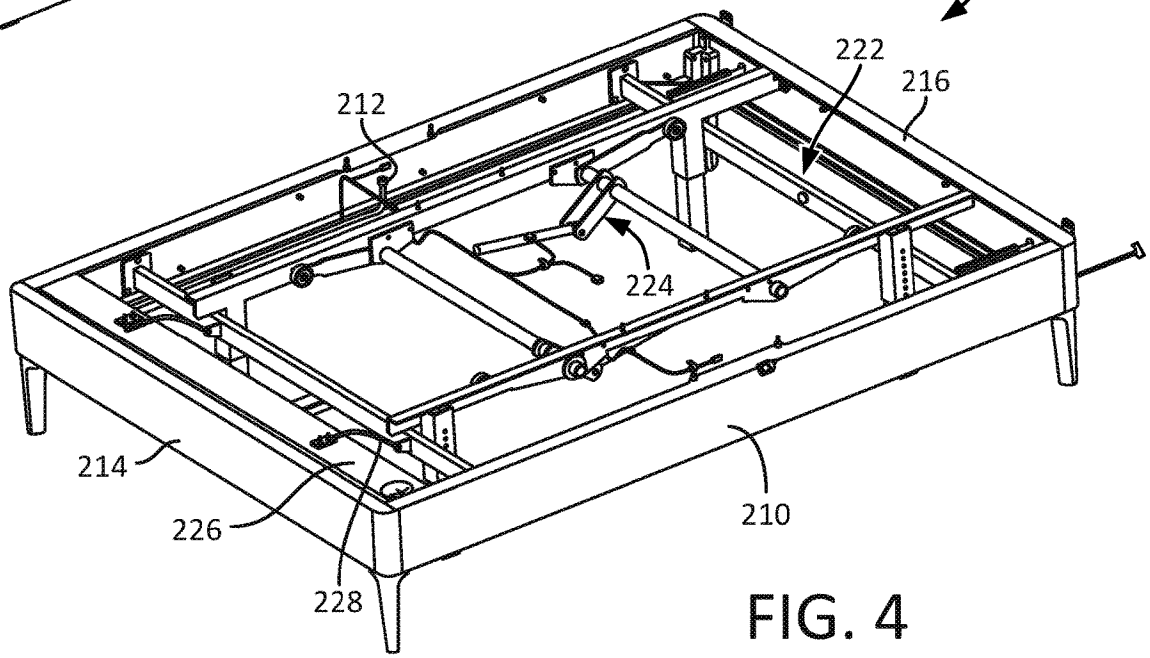
FIG. 4 is perspective view of the foundation of FIG. 3, with deck panels removed.

FIG. 4 is a perspective view of the foundation 200, with the deck panels 202, 204, 206, 208 (shown in FIG. 3) removed, exposing interior components of the foundation 200. With the deck panels 202, 204, 206, 208 removed, inner portions of the head rail 216 and the side rail 212 can be viewed. FIG. 4 also shows the foundation 200 having a sub frame 222 and an articulation mechanism 224 positioned in the foundation and at least partially concealed by the deck panels 202, 204, 206, 208 and the rails 210, 212, 214, 216. The sub frame 222 can provide structural support for other components of the foundation 200, including the deck panels 202, 204, 206, 208, the rails 210, 212, 214, 216, and the articulation mechanism 224. The deck panels 202, 204, 206, 208 can be connected to the sub frame 222 via the articulation mechanism 224.

The foundation 200 can include a cover 226 near a foot of the foundation 200 for covering components contained within the foundation 200 at the foot of the foundation 200. The cover 226 can be hingedly connected to the sub frame 222 via an opening mechanism 228. At least some components in the foundation 200 can be substantially concealed by the cover 226 and the foot rail 214 when the cover 226 is in a closed position even when the deck panel 208 is raised to expose the cover 226.

Figure 5:
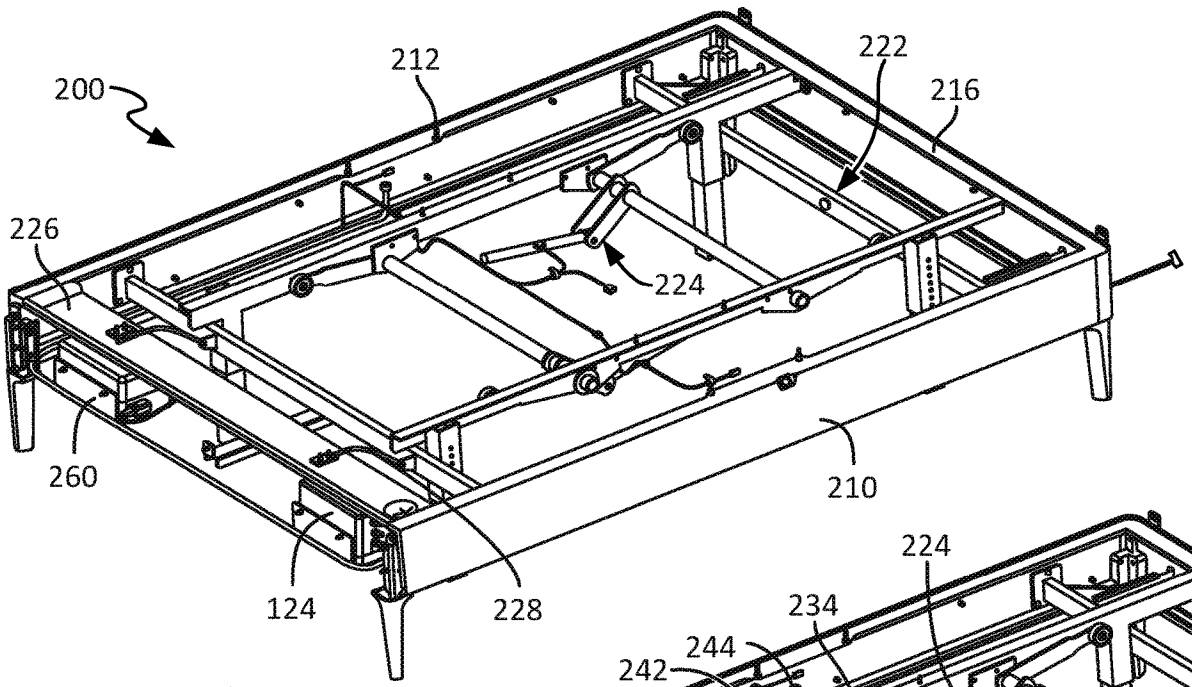
FIG. 5 is perspective view of the foundation of FIG. 3, also with a foot rail removed.

FIG. 5 is a perspective view of the foundation 200, with the foot rail 214 also removed. As shown in FIG. 5, the air controller 124 (including the pump 120) and an actuation controller 260 can be positioned below the cover 226. The cover 226 can be pivoted open to expose and allow access to the air controller 124 and the actuation controller 260 to allow service of components contained within.

Figure 6:
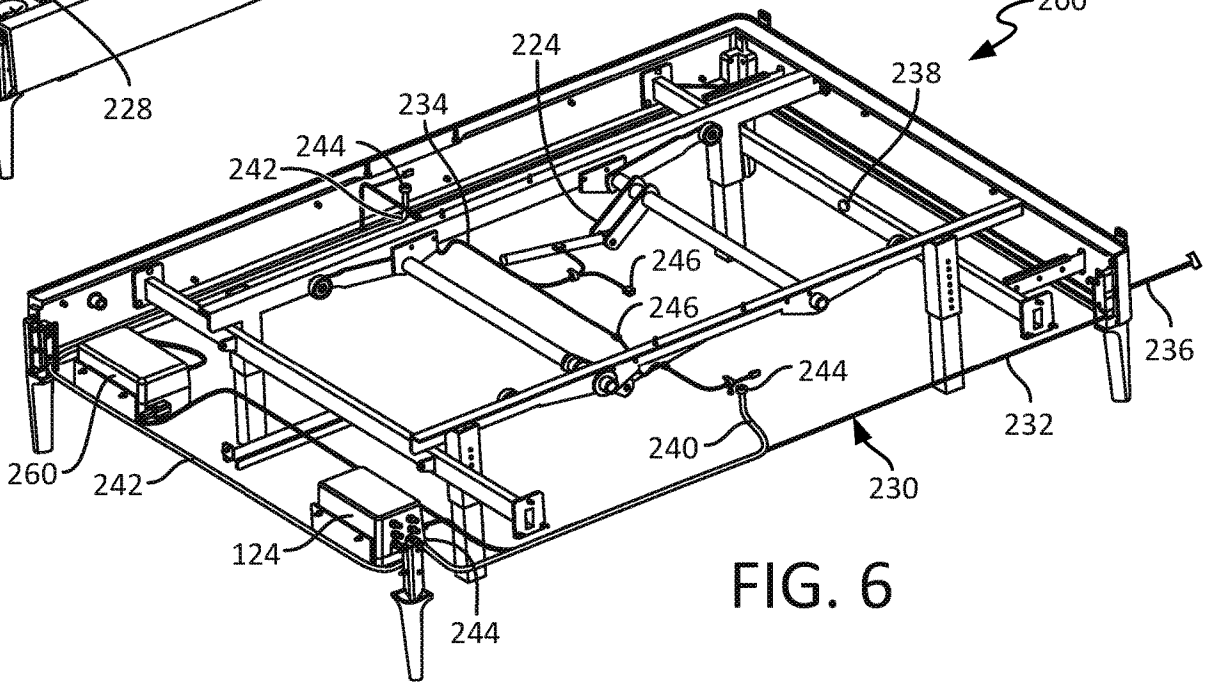
FIG. 6 is perspective view of the foundation of FIG. 3, also with a cover and side rail removed.

FIG. 6 is a perspective view of the foundation 200, with the cover 226 and the side rail 210 also removed. FIG. 6 shows a central power hub 230, which can include a high voltage power system 232 and a low voltage power system 234. The high voltage power system 232 can include an AC (alternating current) power cord 236 which can extend from the foundation 200 to a power source, such as an electrical wall outlet. The high voltage power system 232 can supply power to the air controller 124 and to the actuation controller 260. The low voltage power system 234 can extend from the actuation controller 260 to one or more additional components of the foundation, such as one or more actuation motors (not shown in FIG. 6) of the articulation mechanism 224, an under-bed lighting system 238, and/or other components suitable for being powered by the foundation 200. In some embodiments, the high voltage power system 232 can be an AC power system that operates, for example, at 120V, and the low voltage power system 234 can be a DC (direct current) power system that operates, for example, at one or more lower voltages than the high voltage power system.

FIG. 6 also shows air hoses 240 and 242 extending from the air controller 124. The air hoses 240 and 242 can extend along a perimeter of the foundation 200 to a central portion of the foundation 200, and extend up through the passages 218 and 220 (shown in FIG. 3) to supply air for controlling pressure in air chambers of a mattress. The air hoses 240 and 242 can include connectors 244 configured for quickly connecting and disconnecting at one or more end.

Cords of the high voltage power system 232 and the low voltage power system 234 can also extend along a perimeter of the foundation 200 and can also include connectors 246 configured for quickly connecting and disconnecting at one or more end.

Components, such as the air controller 124, the actuation controller 260, the hoses 240, 242, and the central power hub 230 can be positioned within the foundation 200 in a manner that is substantially concealed from view but is also configured to be repeatably disassembled and reassembled. Components can be disconnected at one or more of the connectors 244 and 246 to be removed from the foundation 200 without necessarily requiring removal of extended length of hose or cable.

Figure 7:
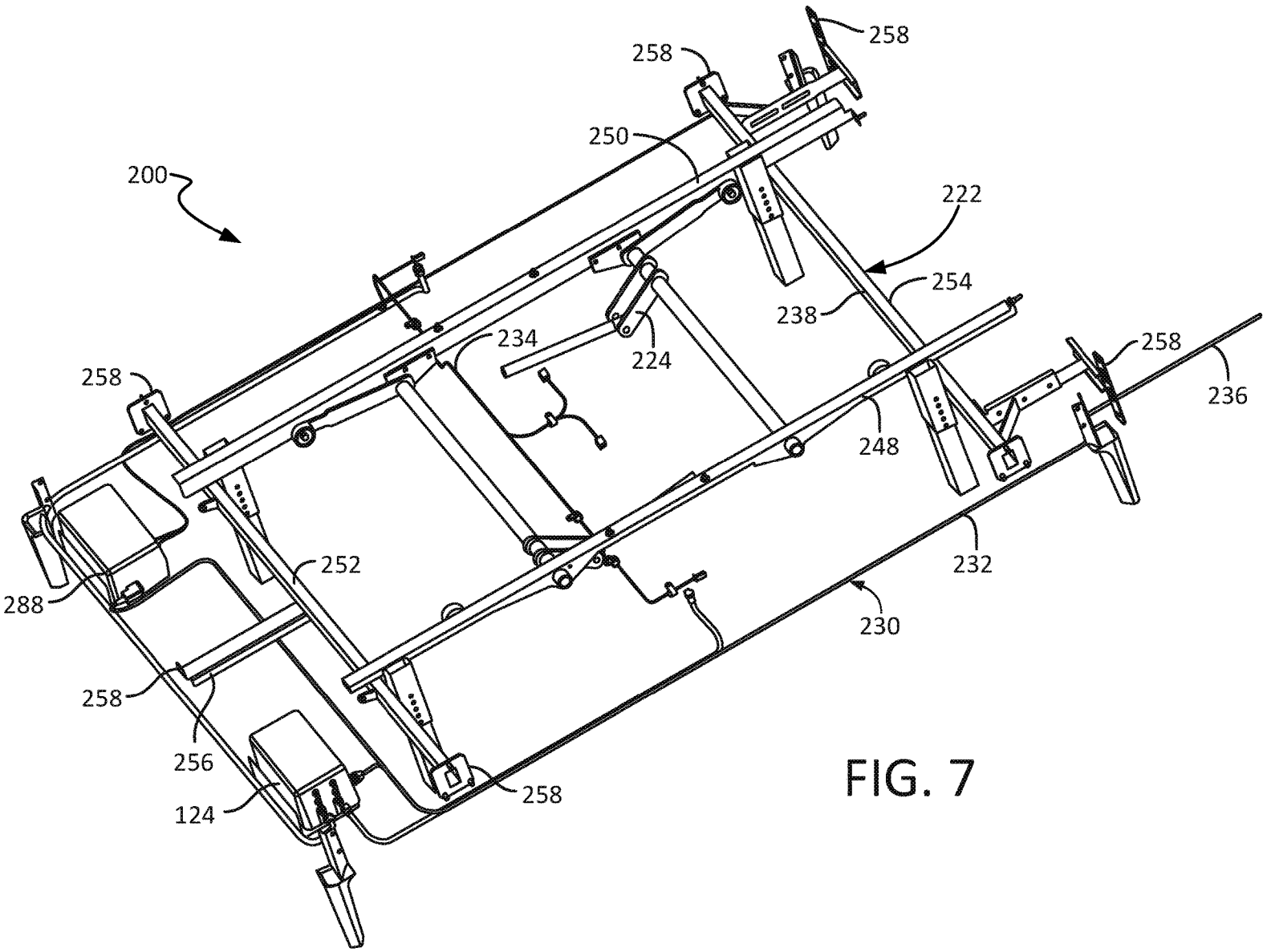
FIG. 7 is perspective view of the foundation of FIG. 3, also with a head rail and side rail removed.

FIG. 7 is a perspective view of the foundation 200, with the head rail 216 and the side rail 212 also removed. FIG. 7 shows the sub frame 222 having a plurality of interconnected supports 248, 250, 252, 254, 256. The supports 248, 250, 252, 254, 256 can extend substantially in a horizontal plane. The supports 248 and 250 can extend along at least part of a length of the foundation 200, substantially parallel to the side rails 210 and 212 and spaced inward of the side rails 210 and 212. The supports 252 and 254 can extend along at least part of a width of the foundation 200, substantially parallel to the head rail 216 and the foot rail 214 and spaced inward of the head rail 216 and the foot rail 214. The supports 252 and 254 can be positioned below and extending across the supports 248 and 250 to provide strength and rigidity for the sub frame 222. The supports 248 and 250 can have a substantially flat upper surface configured for supporting the deck panels 202, 204, 206, 208 (shown in FIG. 3) when the deck panels 202, 204, 206, 208 rest on the supports 248 and 250. The support 256 can extend from the support 252 in a cantilevered manner toward the foot of the bed. One or more connection brackets 258 can be connected to one or more of the supports 248, 250, 252, 254, 256 and be configured for allowing connection of the rails 210, 212, 214, 216 to the supports 248, 250, 252, 254, 256.

In some embodiments, the rails 210, 212, 214, 216 can combine to form a substantially continuous surround. The rails 210, 212, 214, 216 can be difficult to open, such as being designed not to be opened except during disassembly. In some of such embodiments, the foundation 200 can have access mechanisms that allow access for servicing components that do not require removal of the rails 210, 212, 214, 216.

Figure 8:
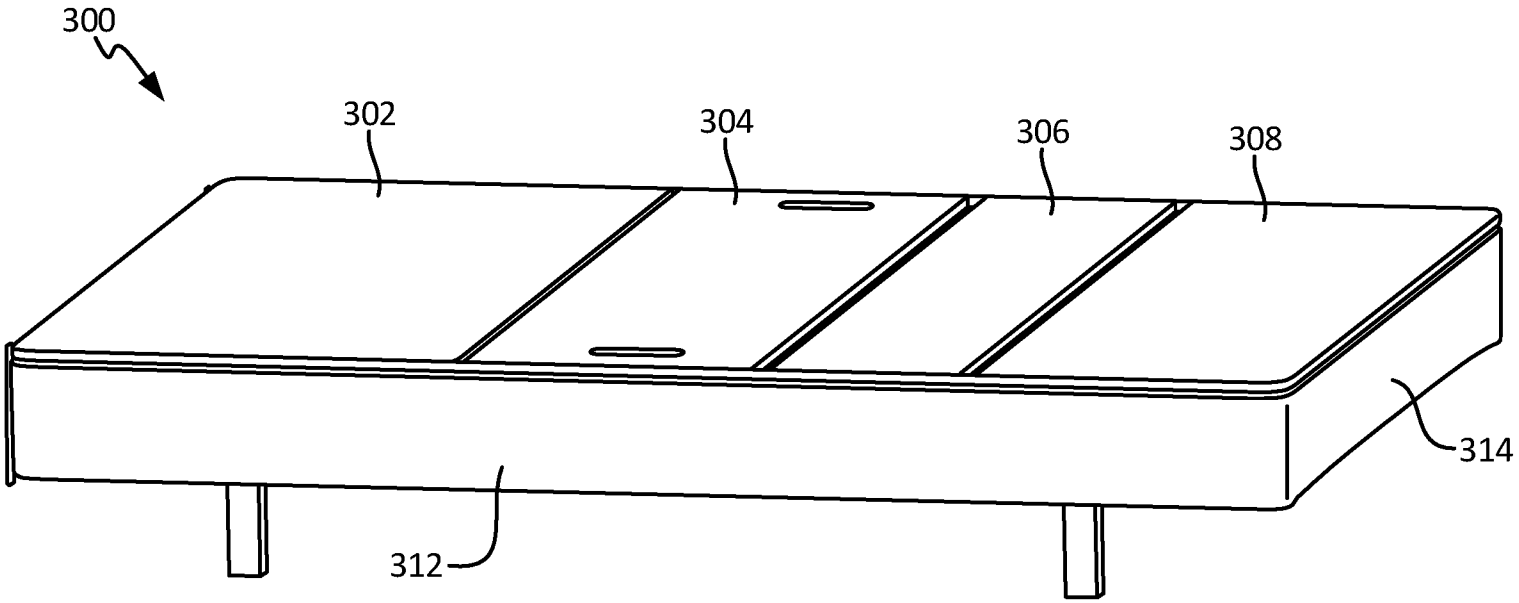
FIG. 8 is a perspective top view of a foundation in a lower position.

FIG. 8 is a perspective top view of a foundation 300. In some embodiments, the foundation 300 can have functions and features that are the same or similar as that described above with respect to foundation 200 (shown in FIGS. 3-7). As illustrated in FIG. 8, the foundation 300 can include one or more deck panels 302, 304, 306, 308, side rails 310 and 312 (the side rail 310 is not shown in FIG. 8), a foot rail 314, and a head rail 316 (not shown in FIG. 8). In some embodiments the foundation 300 can be an articulating foundation, such that one or more of the deck panels 302, 304, 306, 308 are raised and lowered in response to actuating motors. For example, the deck panels 302, 304, 306, and 308 can be interconnected by one or more hinges that connect adjacent deck panels. FIG. 8 shows the foundation and its deck panels 302, 304, 306, 308 in a lower, substantially flat position.

In some embodiments the rails 310, 312, 314, and 316 can form a substantially continuous surround.

Figure 9:
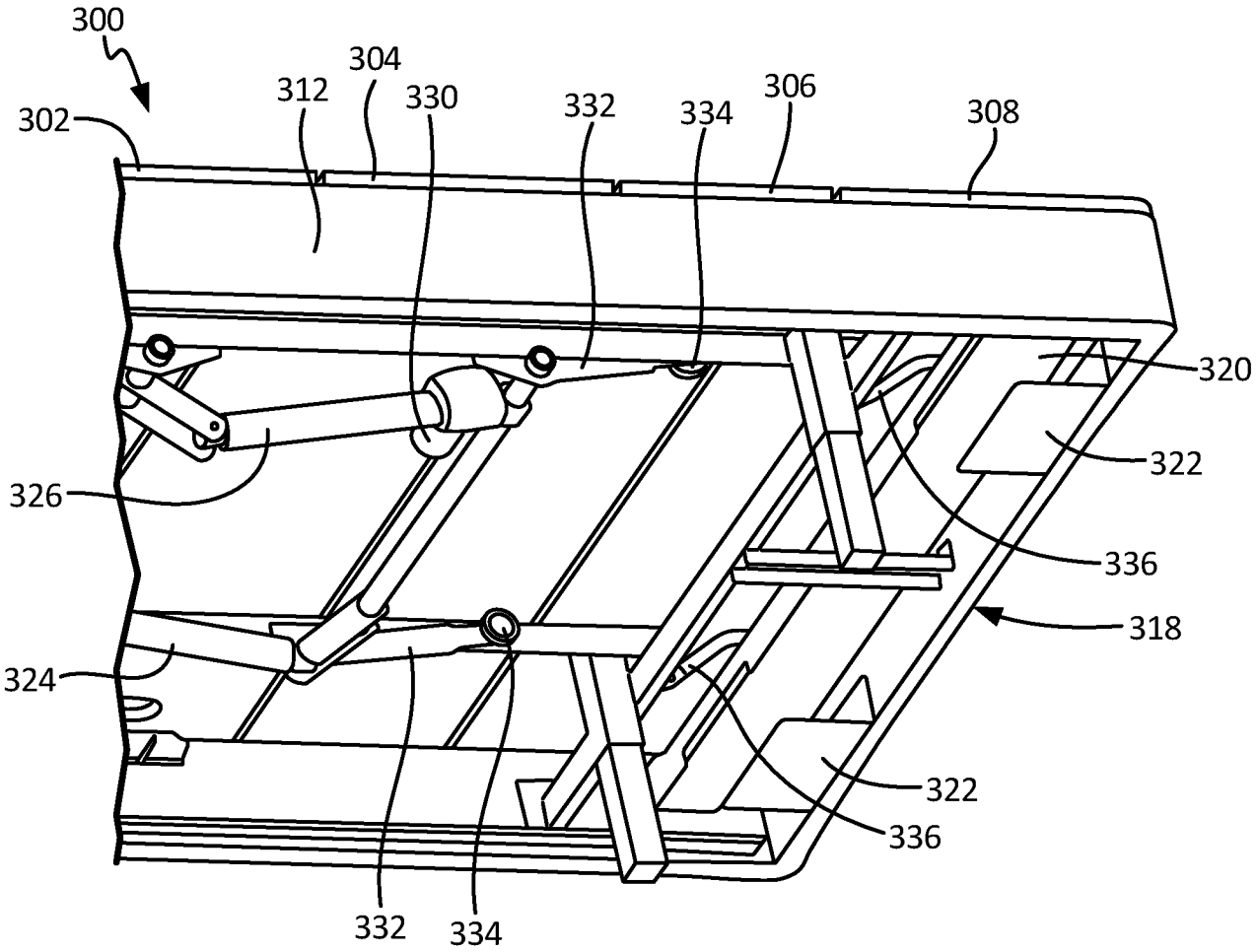
FIG. 9 is a perspective bottom view of the foundation of FIG. 8 at a foot of the foundation.

FIG. 9 is a perspective bottom view of a portion of the foundation 300 at a foot of the foundation 300. The foundation 300 can include a compartment 318 with a cover 320 and one or more support platforms 322. One or more components can be positioned in the compartment 318 to be raised off the floor and positioned in the foundation 300. For example, the air controller 124 (shown in FIGS. 1 and 2) can be positioned on and supported by a support platform 322. In some embodiments, the compartment 318 can be positioned at or near a foot of the foundation 300.

Figure 17:
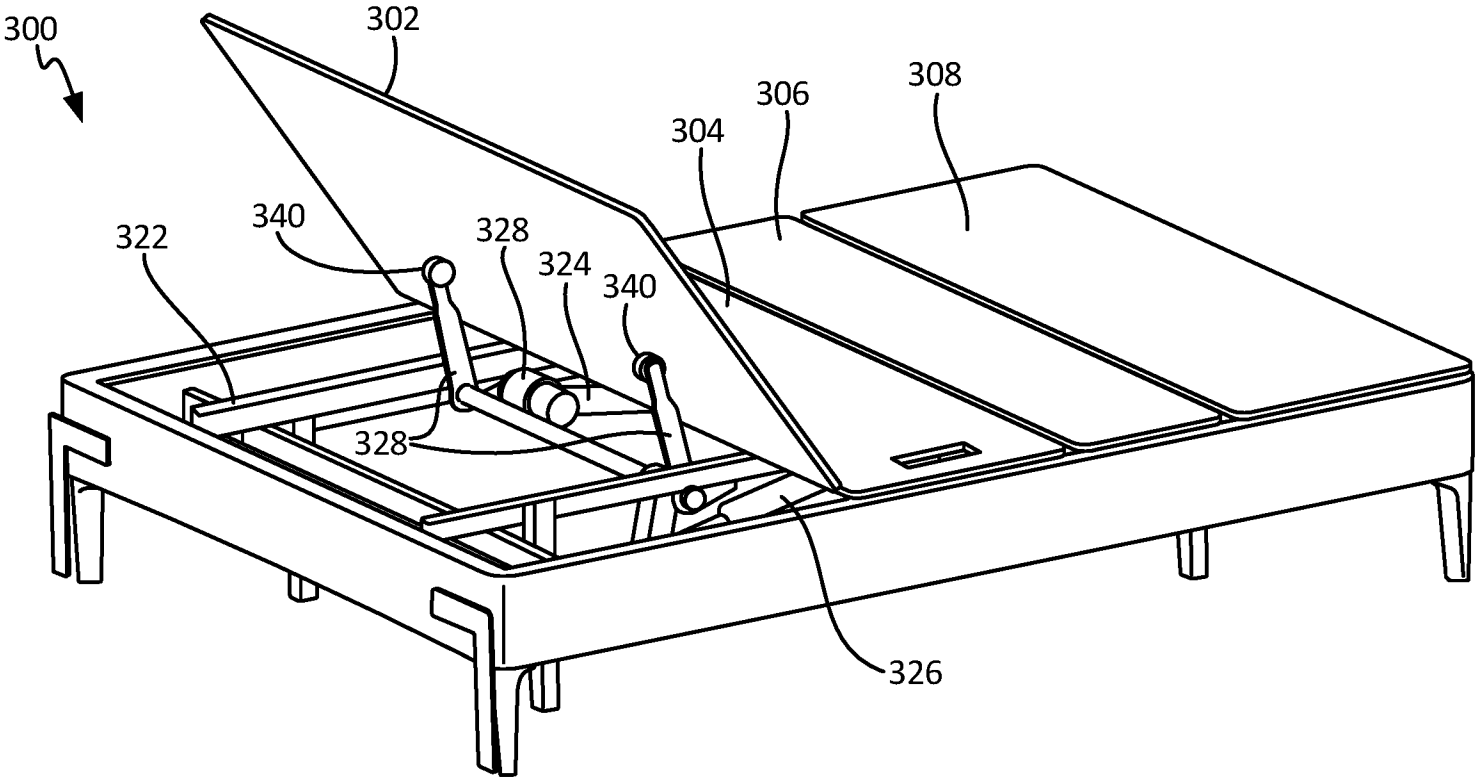
FIG. 17 is a perspective view of the foundation of FIG. 8 at a head of the foundation with a deck panel in a raised position.
Figure 18:
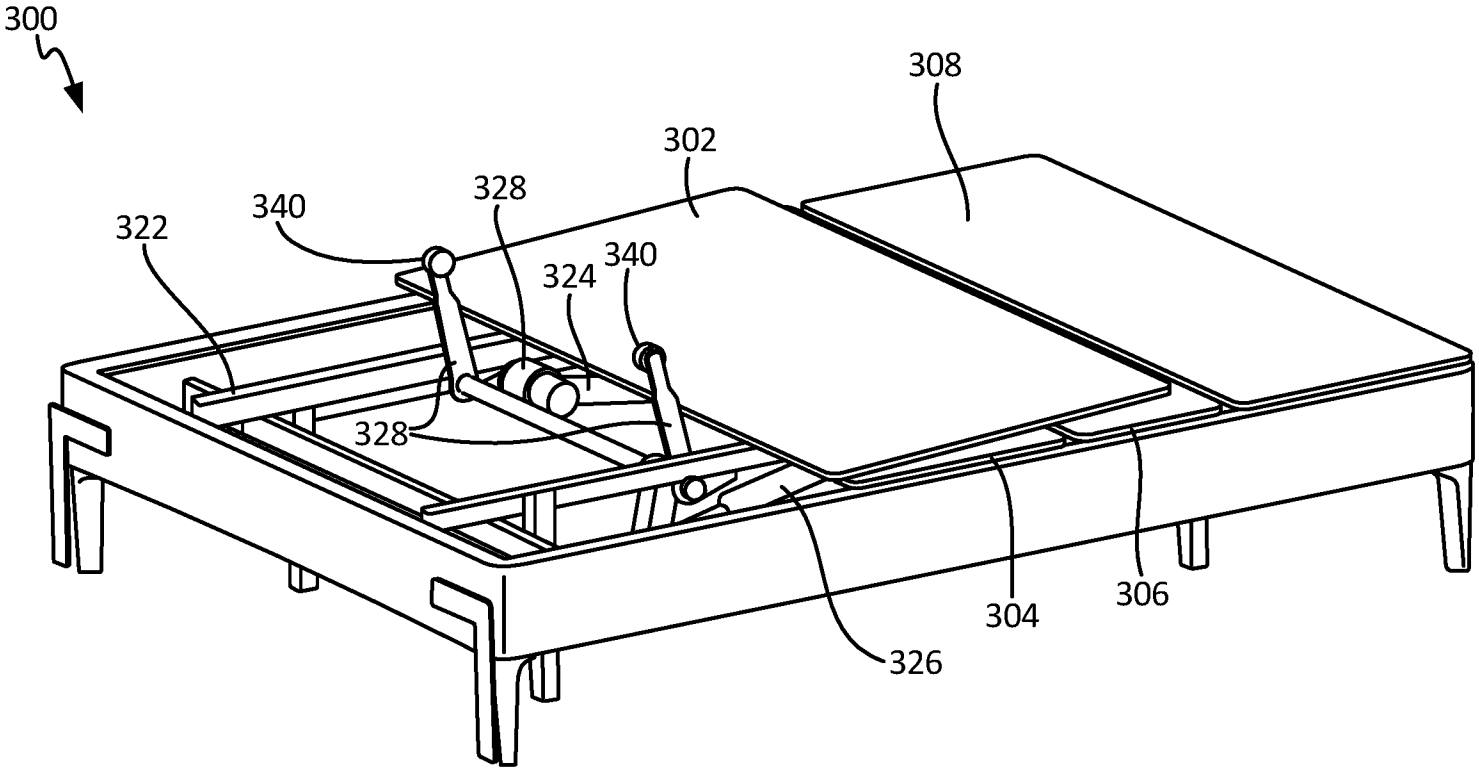
FIG. 18 is a perspective view of the foundation of FIG. 8 at a head of the foundation with a deck panel in a service position.

The foundation 300 can include a sub frame 322 for providing a supporting structure for other components of the foundation 300. Actuators 324 and 326 can be connected to the sub frame 322 for raising and lowering portions of the foundation 300. The actuators 324 and 326 can be electrically powered actuators having electrical motors 328 and 330, respectively (the motor 328 is shown in FIGS. 17-18). The actuator 324 can be operably connected to one or more lever arms 332 with one or more rollers 334 attached thereto. The roller 334 can abut a bottom surface of the deck panel 306 for imparting a lifting force on the deck panel 306 in response to actuation of the lever arm 332 by the actuator 324.

The foundation 300 can also include one or more linkage arms 336 extending from and hingedly connected to the sub frame 322 and the deck panel 308. The deck panel 306 can be hingedly connected to both of the deck panels 304 and 308 to effectively act as a second linkage arm. The deck panel 308 can function as a coupler between the deck panel 306 and the linkage arms 336 so as to form a four-bar-linkage system. Accordingly, when the actuator 324 causes the lever arm 332 to press the roller 334 against the deck panel 306, the resulting force can lift both of the deck panels 306 and 308, where the motion of the deck panel 308 is passively guided by the linkage arms 336.

Figure 10:
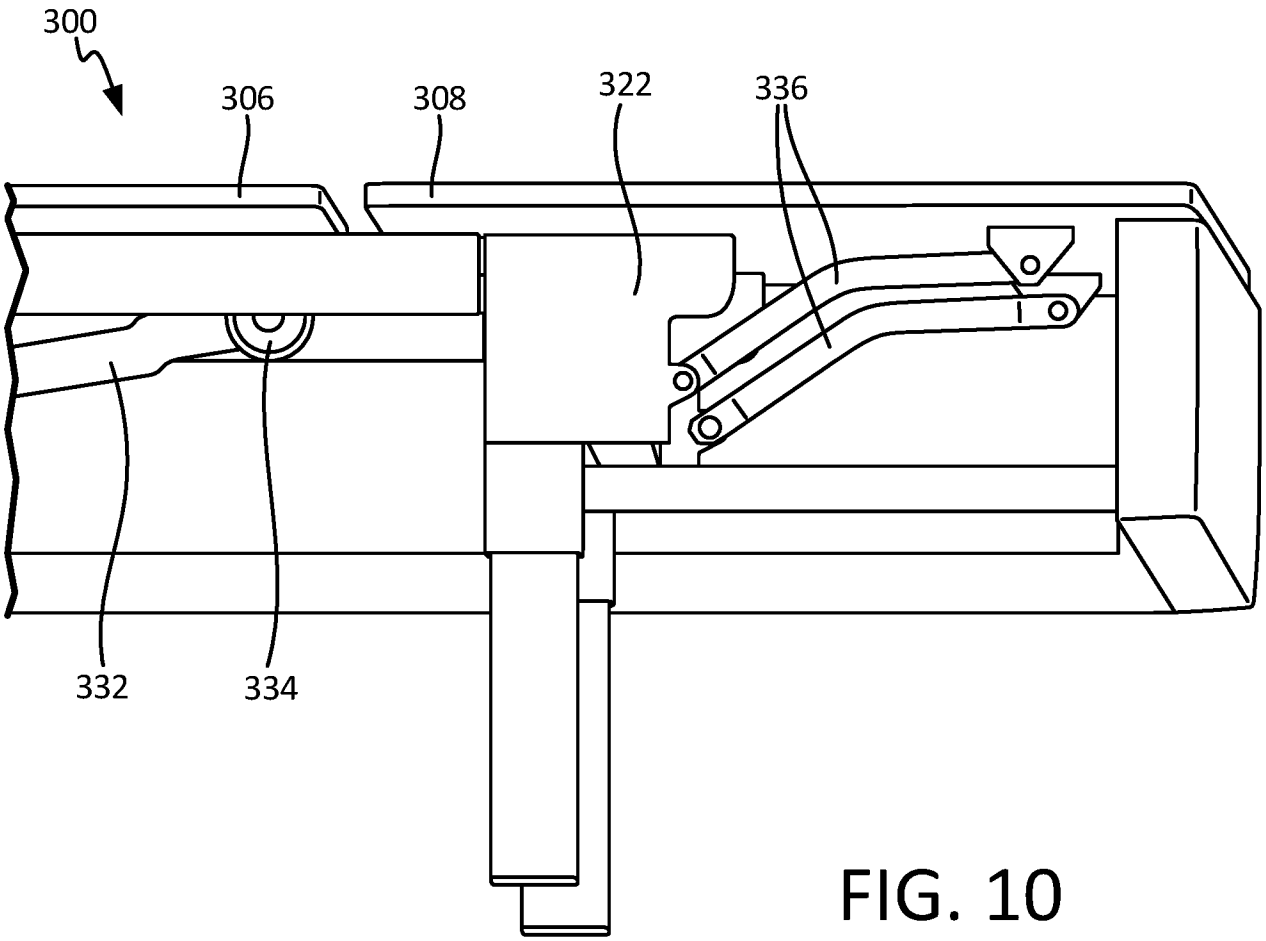
FIG. 10 is a perspective side view of a portion of the foundation of FIG. 8.

FIG. 10 is a perspective side view of a portion of the foundation 300 at a foot of the foundation 300. Certain components including the side rail 312 have been removed to better illustrate other components positioned therein, including the linkage arms 336 pivotably connected to both the deck panel 308 and the sub frame 322.

Figure 11:
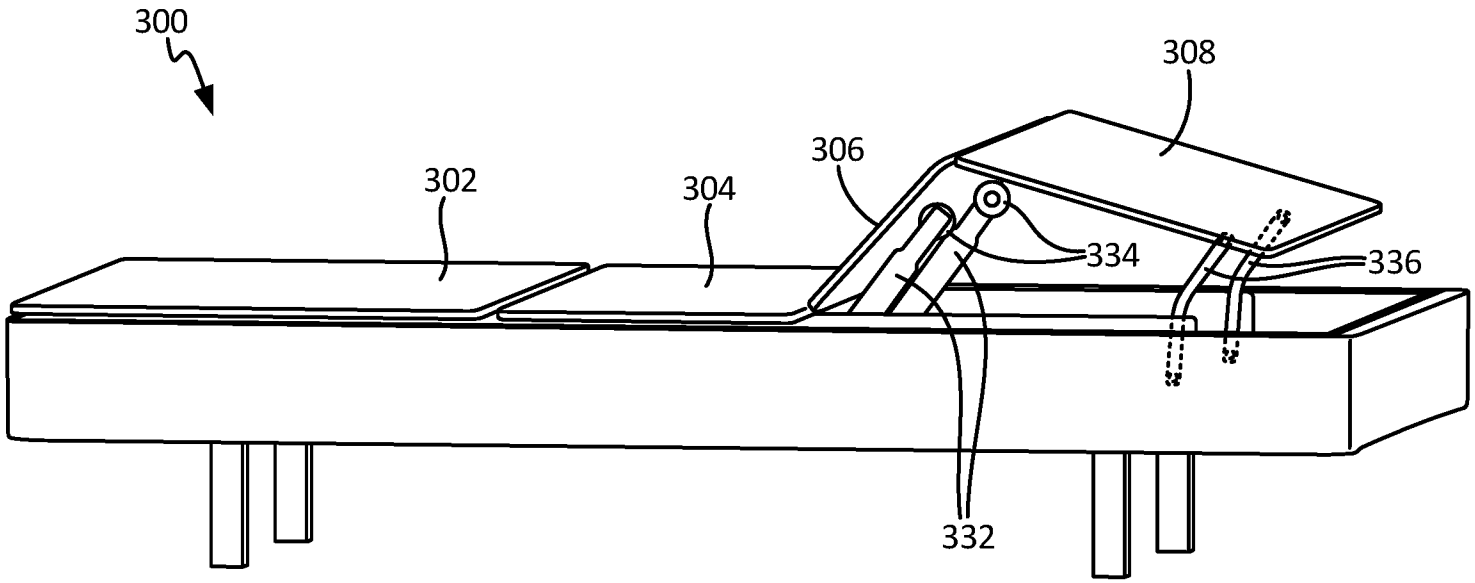
FIG. 11 is a perspective side view of the foundation of FIG. 8 with a deck panel in an upper position.

FIG. 11 is a perspective side view of the foundation 300 with the deck panel 308 in an upper position. In the upper position, the deck panels 306 and 308 can be raised from their positions as shown in FIG. 8, where the deck panels 306 and 308 are substantially flat. The deck panels 306 and 308 can be raised by the actuator 324 (shown in FIG. 9) from the position shown in FIG. 8 to the position shown in FIG. 11, or to positions in-between the illustrated positions, in response to a user request.

In some embodiments, the upper position illustrated in FIG. 11 can be a maximum articulable position for normal operation. For example, the foundation 300 could be mechanically stopped from actuating further, such as by blocking further rotation by the lever arms 332. Alternatively, the actuation controller 260 can be configured to limit actuation of the lever arms 332 to a certain maximum.

Figure 12:
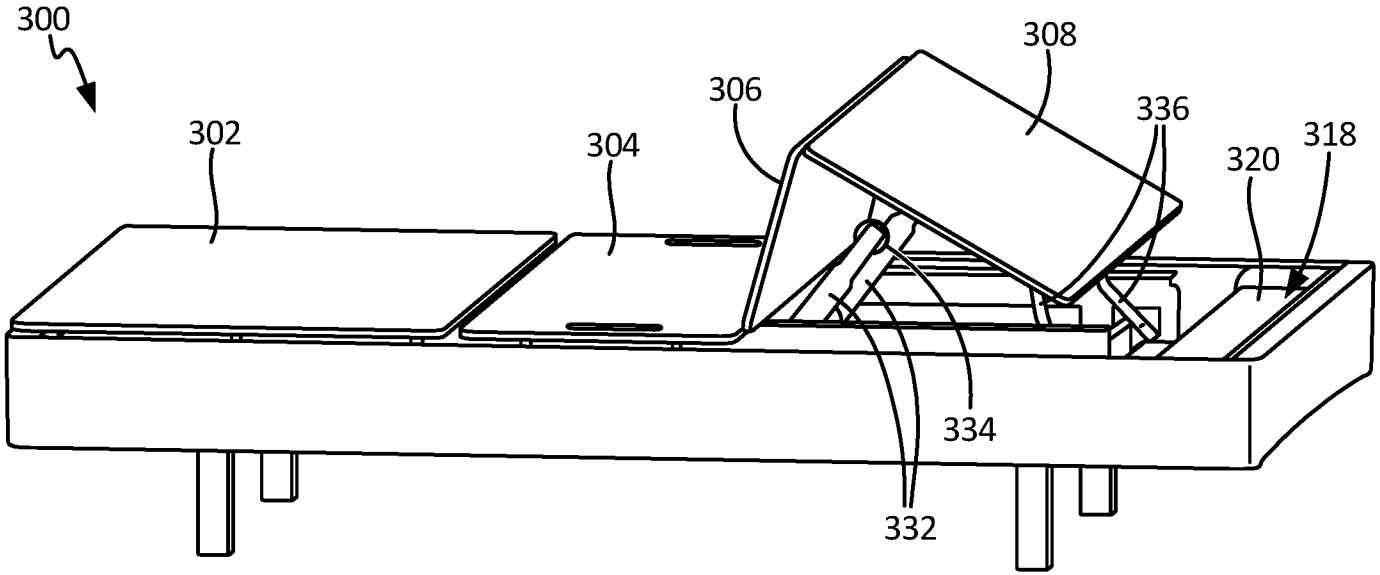
FIG. 12 is a perspective side view of the foundation of FIG. 8 with the deck panel in a service position.

FIG. 12 is a perspective side view of the foundation 300 with the deck panel 308 in a service position. The service position can be further than the upper position and can be configured to be far enough to allow for access to interior components of the foundation 300 for servicing of the foundation.

In some embodiments, the service position can be a position that is further than the maximum position articulable via the actuator 324 (shown in FIG. 9), which can be achieved manually. For example, a user can manually push on the deck panel 308 to force the deck panel 306 to be lifted off the rollers 334, such that the bottom of the deck panel 306 is spaced from the rollers 334. Accordingly, neither of the deck panels 306 and 308 need to be in contact with or otherwise connected to an actuator mechanism in the service position. In alternative embodiments, the foundation 300 can include an actuator mechanism that remains connected to one or more of the deck panels 306 and 308 in the service position.

In the example illustrated in FIGS. 11-12, the actuator 324 can first actuate the lever arms 332 and rollers 334 to the upper position, so as to also raise the deck panels 306 and 308 to the upper position. The user can then push the deck panels 306 and 308 from the upper position to the service position. In other example, the user can push the deck panels 306 and 308 to the service position from a position other than the upper position, such as from the lower position or from a position between the lower position and the upper position.

In some embodiments, the linkage arms 336 can be rotated to a position that is less than vertical in the lower and upper positions (as shown in FIGS. 9-11) and can be over-rotated to a position that is past vertical in the service position (as shown in FIG. 12). Rotating the linkage arms 336 past vertical can allow the deck panels 306 and 308 to remain elevated in the service position, without requiring the user to keep holding the deck panels, due to force of gravity on the deck panel 308 pulling downward to bias the deck panel 308 to the elevated position.

In some embodiments, a mattress supported by the foundation 300 can be removed from the foundation 300 prior to moving the deck panels 306 and 308 to the service position. Removing the mattress can make it easier to push the deck panels 306 and 308 without the additional weight of the mattress. In other embodiments, the deck panels 306 and 308 can be pushed to the service position even with the weight of a mattress that remains on the foundation 300.

Figure 13:
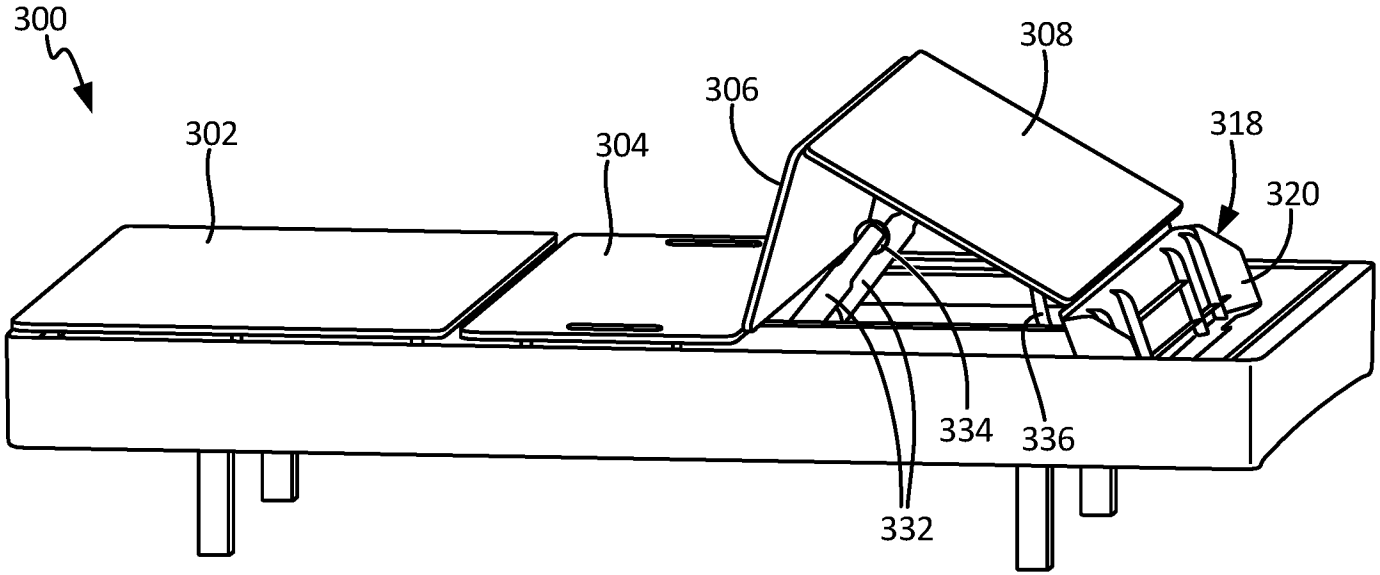
FIG. 13 is a perspective side view of the foundation of FIG. 8 with the deck panel in a service position and a compartment opened.

FIG. 13 is a perspective side view of the foundation 300 with the deck panel 308 in the service position and with the compartment 318 open. In the service position, the cover 320 can be opened to expose serviceable components in the compartment 318. For example, the air controller 124 can be positioned in the compartment, and can be accessed for repair or replacement by moving the deck panels 306 and 308 to the service position and raising the cover 320 of the compartment 318.

Figure 14:
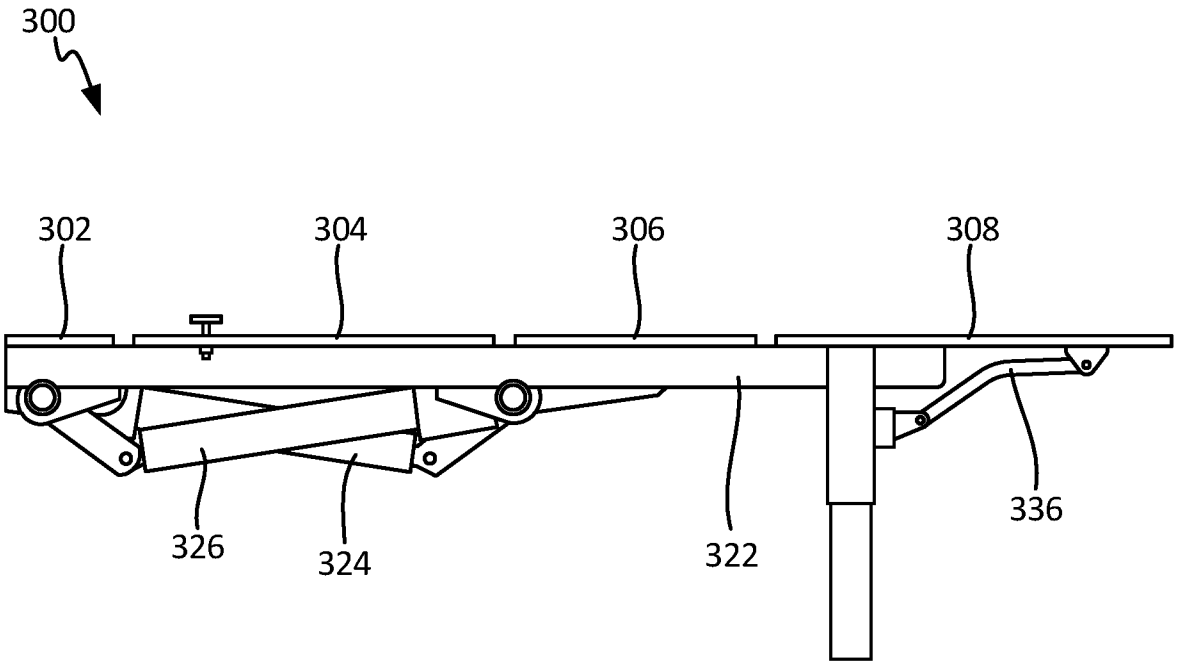
FIGS. 14-16 are perspective side view of a portion of the foundation of FIG. 8 with rails removed to better show interior components.
Figure 15:
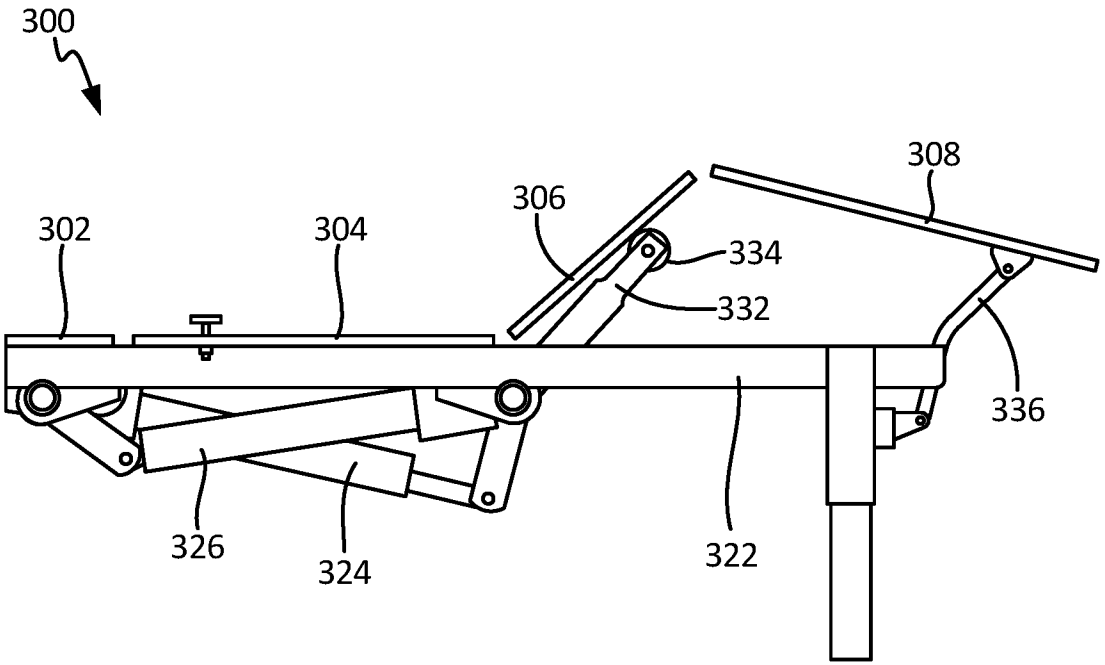
Figure 16:
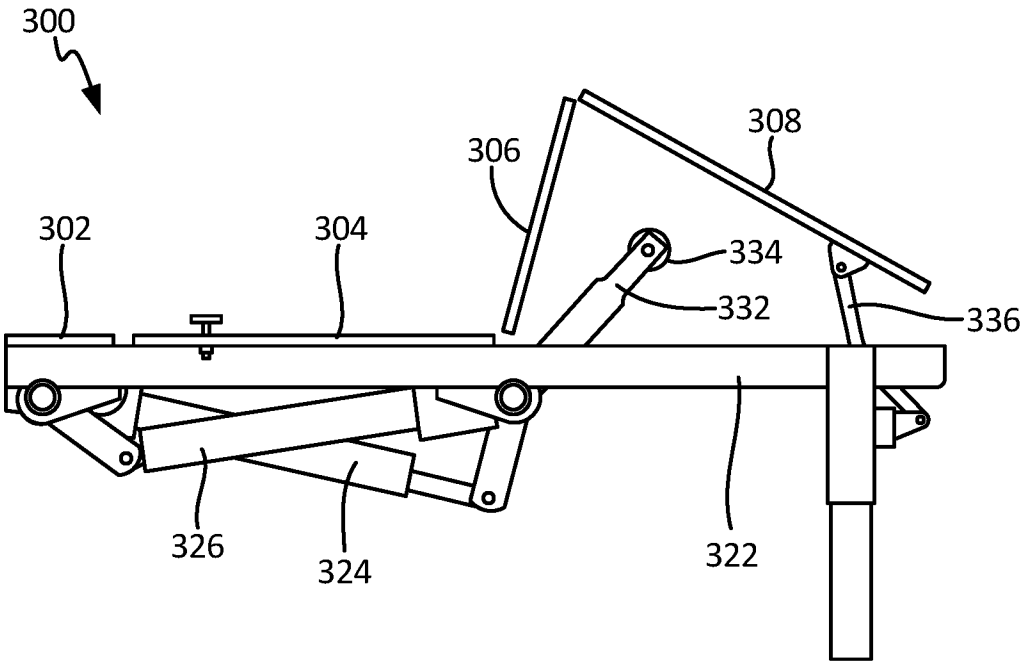

FIGS. 14-16 are perspective side view of a portion of the foundation 300 with the rails 310, 312, 314, and 316 removed to better show interior components. FIG. 14 shows the foundation 300 in the lower position, with the deck panels 302, 304, 306, and 308 lying substantially flat so as to support a mattress lying flat on the foundation 300. FIG. 15 shows the foundation 300 articulated to the upper position so as to support a mattress lying on the foundation 300 with the foot end of the mattress elevated. FIG. 16 shows the foundation 300 in the service position, which has the deck panels 306 and 308 rotated even further than in the upper position to create easier access to an interior of the foundation 300.

FIGS. 14-16 show one example of movement of the deck panel 306, the deck panel 308, and the linkage arms 336 when moving between the lower, upper, and service positions. FIGS. 14-16 also show an example of movement of the actuator 324, the linkage arm 332, and the roller 334 in the lower, upper, and service positions, including that the actuator 324, the linkage arm 332, and the roller 334 can be stationary when the deck panels 306 and 308 are moved to the service position.

In some embodiments, the one or more linkage arms 336 can be angled less than vertical in the lower and upper positions and can be over-rotated past vertical in the service position. For example, in some embodiments, the linkage arms 336 can have an angle between 0 and 40 degrees with respect to horizontal in the lower position, the linkage arms 336 can have an angle between 40 and 80 degrees with respect to horizontal in the upper position, and the linkage arms 336 can be over-rotated to a position with an angle between 100 and 140 degrees with respect to horizontal in the service position. In some embodiments, the linkage arms 336 can have an angle between 17 and 20 degrees with respect to horizontal in the lower position, the linkage arms 336 can have an angle between 59 and 63 degrees with respect to horizontal in the upper position, and the linkage arms 336 can be over-rotated to a position with an angle between 116 and 119 degrees with respect to horizontal in the service position.

As described above, the foundation 300 can be an adjustable foundation with deck panels that can be raised to a service position to allow for service access at a foot of the foundation 300. The foundation 300 can also include a service position that allows for service access at a head of the foundation 300, as further described below with respect to FIGS. 17-18.

FIGS. 17 and 18 are perspective views of the foundation 300 at a head of the foundation 300. FIG. 17 shows the deck panel 302 raised to an upper position and FIG. 18 shows the deck panel 302 in a service position.

The deck panel 302 can be raised from a lower position as shown in FIG. 8, where the deck panel 302, as well as one, more, or all of the deck panels 304, 306, and 308, are substantially flat. The deck panel 302 can be raised by the actuator 326 from the position shown in FIG. 8 to the position shown in FIG. 17, or to positions in-between the illustrated positions, in response to a user request.

The electrical motor 330 of the actuator 326 can drive the actuator 326 to extend and to pivot one or more lever arms 338 that are operably attached to the actuator 326. The lever arms 338 can have rollers 340 attached thereto, which can contact a bottom side of the deck panel 302. As the actuator 326 pivots the lever arms 338 upwards, the lever arms 338 and rollers 340 can raise the deck panel 302 to the upper position shown in FIG. 17.

In some embodiments, the upper position illustrated in FIG. 17 can be a maximum articulable position for normal operation. For example, the foundation 300 can be mechanically stopped from actuating further, such as by blocking further rotation by the lever arms 338. Alternatively, the actuation controller 260 can be configured to limit actuation of the lever arms 338 to a certain maximum.

The deck panel 302 can have a service position that is further than the upper position and that can be configured to be far enough to allow for access to interior components of the foundation 300 for servicing of the foundation 300.

In some embodiments, the service position of the deck panel 302 can be a position that is further than the maximum position articulable via the actuator 324 (such as shown in FIG. 17), which can be achieved manually. For example, a user can manually push on the deck panel 302 to be lifted off the rollers 340, such that the bottom of the deck panel 302 is spaced from the rollers 340. Accordingly, the deck panel 302 need not be in contact with or otherwise connected to an actuator mechanism in the service position. In alternative embodiments, the foundation 300 can include an actuator mechanism that remains connected to the deck panel 302 in the service position.

In some embodiments, the service position of the deck panel 302 can be much further than the upper position. In the example shown in FIG. 18, the deck panel 302 can have a service position in which the deck panel is rotated substantially 180 degrees from its lower position. The deck panel 302 can be rotated so far as to lay substantially flat against the deck panel 304.

In the example illustrated in FIGS. 17-18, the actuator 326 first can first actuate the lever arms 338 and rollers 340 to the upper position, so as to also raise the deck panel 302 to the upper position. The user can then push the deck panel 302 from the upper position to the service position. In other example, the user can push the deck panel 302 to the service position from a position other than the upper position, such as from the lower position or from a position between the lower position and the upper position.

Accordingly, the foundation 300 can have one or more service positions to allow for service access of components in the foundation 300. One or more of the deck panels 302, 304, 306, and 308 can be raised to allow for service access at a head of the foundation 300, at a foot of the foundation 300, or both at the head and the foot of the foundation 300.

By allowing service access at both the head and the foot of the foundation 300, service can be performed at components in both locations. For example, in one embodiment the foundation 300 can include the air controller 124 positioned in the compartment 318 at or near the foot of the foundation 300, while one or more other components can be positioned at or near the head and/or center of the foundation 300. The actuation controller 260 can be positioned at a location under the deck panel 304, which can be more easily serviced by moving the deck panel 302 to a service position. Moreover, the actuators 324 and 326 can be more easily serviced by having service access at both the head and the foot of the foundation 300.

By allowing service panels to be moved to service positions that are further than maximum articulable positions, service access can be improved over what would otherwise be available in a foundation that actuated only to positions intended for purposes other than service access.

A number of embodiments of the inventions have been described. Nevertheless, it will be understood that various modifications can be made without departing from the spirit and scope of the invention. For example, in some embodiments the foundation can be used with a bed system having a mattress that does not include adjustable air chambers. Moreover, in some embodiments various components of the foundation can be shaped differently than as illustrated. For example, the figures show one example of frame components and actuation components suitable for the application. However, the foundation can be modified to include different frame and actuation components that are suitable for the application of providing service access as described herein. The foundation can also have more or fewer deck panels than as illustrated. Additionally, different aspects of the different embodiments of foundations, mattresses, and other bed system components described above can be combined while other aspects as suitable for the application. Accordingly, other embodiments are within the scope of the following claims.

What is claimed is:

1. A foundation for a bed system, the foundation comprising: a deck having a plurality of deck panels including a head deck panel, a second deck panel, and a foot deck panel, wherein the head deck panel is hingedly connected to the second deck panel and rotatable with respect to the second deck panel to a lower position, a raised position, and a service position, wherein the head deck panel is hingedly connected to the second deck panel in each of the lower position, the raised position, and the service position, wherein the head deck panel and the second deck panel are substantially flat and parallel in the lower position, wherein the head deck panel and the second panel form an obtuse angle between 180 and 90 degrees in the raised position, and wherein the head deck panel and the second panel form an acute angle of less than 90 degrees in the service position; and an actuator comprising an arm and a motor operably connected to the arm, wherein the actuator is configured to operate the motor and arm to move the head deck panel from the lower position to the raised position but not to the service position, and further comprising: at least one linkage arm connected between the frame and the foot deck panel with a first linkage arm end connected to the frame and a second linkage arm end connected to the foot deck panel, wherein the linkage arm is angled less than vertical such that the second linkage arm end is positioned further from a head end of the foundation when the foot deck panel is in lower foot and upper foot positions, and wherein the linkage arm is over-rotated past vertical such that the second linkage arm end is positioned closer to the head end of the foundation when the foot deck panel is in a foot service position; and a second actuator comprising a second arm and a second motor operably connected to the second arm, wherein the second actuator is configured to operate the second motor and second arm to move the foot deck panel from the lower foot position to the raised foot position but not to the foot service position.

2. The foundation of claim 1, wherein the head deck panel is rotated so far as to lay substantially flat against the second deck panel in the service position.

3. The foundation of claim 1, wherein the actuator comprises a roller attached to an end of the arm, wherein the roller is in contact with a bottom of the head deck panel in the lower position and in the raised position, wherein the roller is not in contact with the bottom of the head deck panel in the service position.

4. The foundation of claim 3, wherein the head deck panel is configured to be rotated from the raised position to the service position by manually pushing the head deck panel away from the roller.

5. The foundation of claim 1, wherein the head deck panel is movable from the raised position to the service position without disconnecting components of the actuator or the deck.

6. The foundation of claim 1, wherein the deck further comprises a third deck panel, wherein the foot deck panel is hingedly connected to the third deck panel and the third deck panel is hingedly connected to the second deck panel.

7. The foundation of claim 6, wherein the second deck panel is rigidly connected to a frame of the foundation and wherein the head, third, and foot deck panels are configured to be raised.

8. The foundation of claim 6, wherein the head, second, third, and foot deck panels have a common width in a direction from a foundation left side to a foundation right side, wherein the head, second, third, and foot deck panels each have a respective length in a direction from a foundation head to a foundation foot, and wherein the length of the head panel is greater than the lengths of each of the second, third, and foot panels.

9. A bed system comprising:

the foundation of claim 1;

an air mattress;

an air controller positioned below either the head deck panel or the foot deck panel; and an air hose extending from the air controller through a hole in the second deck panel to the air mattress.

10. A foundation for a bed system, the foundation comprising:

a frame;

a deck having a plurality of deck panels including a head deck panel, a thigh deck panel, and a foot deck panel, wherein the foot deck panel has a foot edge positioned proximate a foot of the foundation and a second edge positioned opposite of the foot edge, wherein the foot deck panel is hingedly connected to the thigh deck panel proximate the second edge of the foot deck panel, wherein the foot deck panel is movably between a lower position, a raised position, and a service position, wherein the foot deck panel is hingedly connected to the thigh deck panel in each of the lower position, the raised position, and the service position;

at least one linkage arm connected between the frame and the foot deck panel with a first linkage arm end connected to the frame and a second linkage arm end connected to the foot deck panel, wherein the linkage arm is angled less than vertical such that the second linkage arm end is positioned further from a head end of the foundation when the foot deck panel is in the lower and upper positions, and wherein the linkage arm is over-rotated past vertical such that the second linkage arm end is positioned closer to the head end of the foundation when the foot deck panel is in the service position; and an actuator comprising an arm and a motor operably connected to the arm, wherein the actuator is configured to operate the motor and arm to move the foot deck panel from the lower position to the raised position but not to the service position.

11. The foundation of claim 10, wherein the foot panel of the deck mechanism is configured to stay in the service position without assistance of the actuator once the deck mechanism is moved to the service position.

12. The foundation of claim 10, wherein the actuator comprises a roller attached to an end of the arm, wherein the roller is in contact with a bottom of the thigh deck panel in the lower position and in the raised position, wherein the roller is not in contact with the bottom of the thigh deck panel in the service position.

13. The foundation of claim 12, wherein the foot deck panel is configured to be rotated from the raised position to the service position by manually pushing the foot deck panel such that the thigh deck panel moves away from the roller.

14. The foundation of claim 10, wherein the foot deck panel is movable from the raised position to the service position without disconnecting components of the actuator or the deck.

15. The foundation of claim 10, wherein the deck further comprises a second deck panel, wherein the foot deck panel is hingedly connected to the thigh deck panel, the thigh deck panel is hingedly connected to the second deck panel, and the second deck panel is hingedly connected to the head deck panel.

16. The foundation of claim 15, wherein the second deck panel is rigidly connected to a frame of the foundation and wherein the head, thigh, and foot deck panels are configured to be raised.

17. The foundation of claim 15, wherein the head, second, third, and foot deck panels have a common width in a direction from a foundation left side to a foundation right side, wherein the head, second, thigh, and foot deck panels each have a respective length in a direction from a foundation head to a foundation foot, and wherein the length of the head panel is greater than the lengths of each of the second, third, and foot panels.

18. The foundation of claim 10, wherein the at least one linkage arm comprises a second linkage arm connected between the frame and the foot deck panel and wherein the actuator comprises a second arm and second roller.

19. The foundation of claim 10, wherein the second linkage arm end is connected proximate the foot edge of the foot deck panel.

* * * * *